US006400239B1

(12) United States Patent
Chun et al.

(10) Patent No.: US 6,400,239 B1
(45) Date of Patent: Jun. 4, 2002

(54) MICROWAVE FILTER WITH A MOVABLE SHIELD HAVING ALIGNMENT WINDOWS

(75) Inventors: Oh Gon Chun; Chang Hwa Lee, both of Taejon; Bon Hee Koo, Daegu; Dong Suk Jun; Sang Seok Lee, both of Taejon, all of (KR)

(73) Assignee: Electronics and Telecommunications Research Institute, Taejon (KR)

( * ) Notice: Subject to any disclaimer, the term of this patent is extended or adjusted under 35 U.S.C. 154(b) by 0 days.

(21) Appl. No.: 09/498,997

(22) Filed: Feb. 4, 2000

(30) Foreign Application Priority Data

Dec. 20, 1999 (KR) ..... 99-59435

(51) Int. Cl.[7] ..... H01P 1/20
(52) U.S. Cl. ..... 333/206; 333/202; 333/207
(58) Field of Search ..... 333/202, 206, 333/207

(56) References Cited

U.S. PATENT DOCUMENTS 4,954,796 A 9/1990 Green et al. ..... 333/206
5,278,527 A 1/1994 Kenoun et al. ..... 333/202
5,745,018 A 4/1998 Vangala ..... 333/202
5,864,265 A * 1/1999 Ballance et al. ..... 333/206
5,959,511 A * 9/1999 Pasco et al. ..... 333/206

* cited by examiner

*Primary Examiner*—Robert Pascal
*Assistant Examiner*—Patricia T. Nguyen
(74) *Attorney, Agent, or Firm*—SEED IP Law Group PLLC

(57) ABSTRACT

The objcet of the present invention is to provide a microwave filter having a shield for electromagnetic interference shielding, wherein the filter is adaped for use in a radio frequency circuitry located in a stage next to an antenna for a radio communication system, such as a mobile communication system, a portable communication system, satellite communication system, and IMT-2000, for passing signals having desired frequencies while removing signals having frequencies having undesired frequencies.

According to the present invention, there is provided a microwave filter for electromagnetic interference shielding, comprising a block of dielectric material plated with a metal with the exception of one surface, a plurality of resonators contained within the dielectric block, and a shield fixed on the surface which is not plated, wherein the shield has at least an alignment window for securing the easy alignment between the dielectric block and the shield through a visual observation.

8 Claims, 3 Drawing Sheets

MICROWAVE FILTER WITH A MOVABLE SHIELD HAVING ALIGNMENT WINDOWS

TECHNICAL FIELD

The present invention is related to a microwave filter having means for electromagnetic interference shielding, and in particular to a filter adapted for use in a radio frequency circuitry located in a stage next to an antenna for a radio communication system, such as a mobile communication system, a portable communication system, satellite communication system, and IMT-2000, for passing signals having desired frequencies while removing signals having undesired frequencies.

BACKGROUND OF THE INVENTION

Recently, it is requested to use a transmitting frequency band and a receiving frequency band in a more close relationship to more effectively use frequencies, so that a filter used in a radio frequency circuit of a communication system of the type as explained in the above is necessary to have more superior attenuation characteristics in a prohibition band having frequencies higher or lower than a passband. Furthermore, it is requested to miniaturize and lighten the microwave filter in step with the tendency of miniaturizing and lightening communication systems.

In general, a conventional filter is composed of a plurality of resonators which do not have a shield for electromagnetic interference shielding.

In order to solve problems involved in the conventional filter of the type as explained in the above, various researches have been made. The most representative researches are proceeded in a way to cover all surfaces with a conductive material with the exception of a certain portion, and to use a shield for electromagnetic interference shielding.

One representative example of the prior art in this regard is disclosed in U.S. Pat. No. 4,954,796, "Multiple Resonator Dieletric Filter" in the names of Michael F. Moutrie and Phillip J. Gordon.

In summary, the above patent discloses a radio frequency duplexer comprising a receiver filter and a transmitter filter which are separately manufactured and surface-mounted on a printed circuit board, wherein the receiver and transmitter filters comprise a plurality of resonators enclosed within a cylindrical dieletric block and internal surfaces of the filters are plated with a conductive material, and wherein one end of each resonator is connected to one end of the dielectric block and a certain part of the resonator is also plated. The receiver and transmitter filters have a construction for rendering their input and output terminals to be readily connected with input and output parts of the printed circuit board, and the construction includes a plurality of tabs for supporting the connection between the input and output terminals of the dielectric block and the board.

However, the invention disclosed in the above patent has a problem in that it is difficult to improve its performance to a desired level, since it should also perform a function for connecting a shield or a bracket to the input and output terminals of the filter and to the input and output parts of the printed circuit board. Another example of the prior arts is disclosed in U.S. Pat. No. 5,745,018, "Ceramic filter with a coplanar shield" issued in the name of Reddy R. Vangala.

In brief, this patent provides a microwave filter comprising a shield, wherein a prescribed spacing between an opening of a dielectric block and the shield is defined as a height of a protrusion connected to the shield and the shield does not have to be directly connected to a printed circuit board, whereby its surface-mounting area can be reduced. The shield is directly connected to the opening of the dielectric block. The upper part of the shield formed from a metallic material coated with a tin film is provided with a plurality of windows for frequency trimming and the protrusion is directly connected to a metalized pattern formed on the opening of the dielectric body.

Yet, another example of the prior art is disclosed in U.S. Pat. No. 5,278,527, "Dieletric filter and shield therefor" issued in the names Robert Kenoun and Darioush Agahi Kesheh.

The dielectric filter assembly disclosed in this patent comprises a dielectric filter formed of a block of dielectric material and provided with at least one windows for frequency trimming, and an L-shaped shield formed of an electromagnetic wave-absorptive material and having a first sheet portion seated upon one of the side surfaces of the dielectric block and a second sheet portion positioned to cover the opening parts of the dielectric block. In addition, it is possible to fix the shield within a recess formed in the body of filter.

Filters disclosed in the lastly mentioned two patents are advantageous in that the prescribed spacing can be easily obtained. However, they have some problems in that frequency trimming is difficult to be performed once the shield is fixed to the dielectric block, and since, in particular, the shield is not sufficiently contacted to the ground surface of a printed circuit board, they does not have sufficient grounding capability and thus it is impossible to insure attenuation characteristics and standing wave ratios to be obtained by using the shield.

SUMMARY OF THE INVENTION

The present invention is conceived to solve the above problems in ther art. It is the object of the present invention to provide a microwave filter having a shield for electromagnetic interference shielding, wherein the filter is adapted for use in a radio frequency circuit located in a stage next to an antenna for a radio communication system, such as a mobile communication system, a portable communication system, satellite communication system, and IMT-2000, for passing signals having desired frequencies while removing signals having frequencies having undesired frequencies.

In order to achieve the foregoing, the embodiments of the present invention provide a microwave filter for electromagnetic interference shielding, comprising a block of dielectric material plated with a metal with the exception of one surface, a plurality of resonators contained within the dielectric block, and a shield fixed on the plated surface of the block, wherein the shield has at least an alignment window for securing the easy alignment of the dielectric block and the shield through a visual observation.

Preferably, the shield has a folded end remote from the part fixed to the dielectric block, so that the shield can be easily grounded to a ground of a printed circuit board.

It is preferred that the surface of the shield fixed on the dielectric block is folded backward, so that the frequency trimming can be easily performed even after the shield is fixed on the dielectric block.

It is also preferred that the shield is formed with an embossed part, by which projections are formed on the inside of the shield while grooves are formed on the outside of the shield, so that the easy alignment, through a visual observation, of the dielectric block and the shield can be secured and a required spacing between them can be obtained.

The above and other objects and advantages will be more fully understand by a skilled person in the art from the explanation of embodiments to be described below with reference to the accompanying drawings.

BRIEF DESCRIPTION OF THE DRAWINGS

The embodiments of the present invention will be explained with reference to the accompanying drawings, in which.

DETAILED DESCRIPTION OF THE INVENTION

Figure 1:
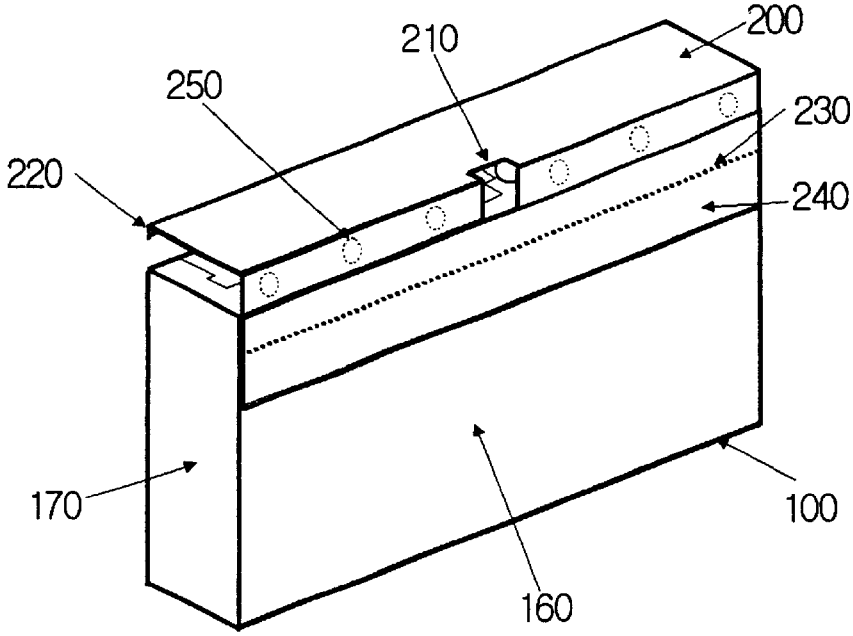
FIG. 1 is a perspective view showing a microwave filter with a shield having a movable part for alignment, in accordance with an embodiment of the present invention.

As shown in the drawings, the microwave filter comprising a dielectric block 100, a shield 200, an adhering part between the dielectric block and the shield, an input electrode 110 of the filter, an input feeding line 111, a non-plated input 112, an output electrode 120 of the filter, an output feeding line 121, a non-plated output 122, an antenna electrode 130, an antenna feeding line 131, a non-plated antenna section 132, a plurality of internally plated resonators 140, a non-plated opening 150 of the dielectric block 100, and a plated front side 160 and plated lateral sides 170 of the dielectric block 100.

In addition, the shield 200 comprises a wide ground 220, an alignment window 210, a movable part 230, and a plurality of projections.

Figure 2:
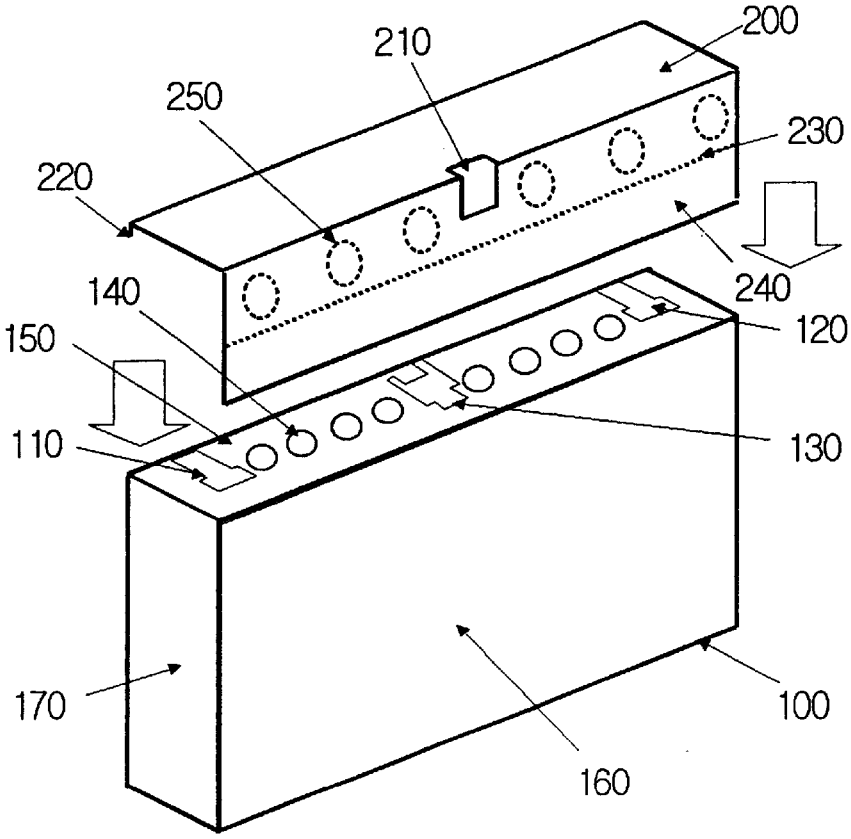
FIG. 2 is a perspective view showing the assembling of the microwave filter of FIG. 1.

As shown in FIG. 2, the microwave filter having a shield movable for alignment according to a preferred embodiment of the present invention allows to adhere the shield 200 to the dielectric block 100 using an adhesive, after visually confirming through the alignment window 210 whether an end of the opening 150 of the dielectric block 100 is accurately aligned with the lower end of the alignment window 210.

A conventional dielectric block has been provided with a projection, a groove or a special element to obtain a prescribed spacing between the dielectric block and the shield. According to the present invention, however, at least an alignment window is formed at the time of manufacturing the shield to be used when aligning and adhering the dielectric block and the shield. While assembling the filter, it may be convenient to use projections rather than to visually confirm through windows so as to secure the prescribed spacing between the dielectric block and the shield. However, the visual confirmation as in the present invention is necessary while assembling the filter, because the conductive adhesive may be leaked in the process of coating it on the dielectric block or the internal surface of the shield, propagated to the opening 150 of the dielectric block, and adversely affect to an electrical circuit.

Furthermore, the shield 200 is provided with an embossed part 250 forming projections on the internal surface while forming grooves on the outer surface of the shield, so as to secure easy alignment between the dielectric block and the shield through visual observation, as well as to obtain the prescribed spacing between them.

Figure 3:
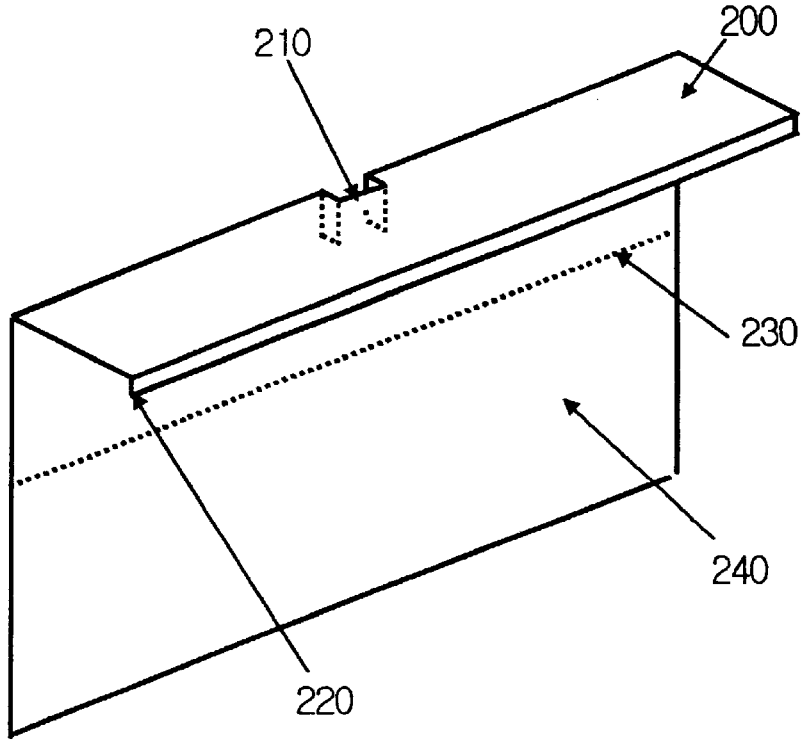
FIG. 3 is a perspective view of the shield shown in FIG. 1.

FIG. 3. shows the shield shown in FIGS. 1 and 2 in detail. The shield comprises an alignment window 210 for obtaining a prescribed spacing between the shield and the dielectric block 100, a wide ground part 220 for enhancing adhering effect between a ground surface of the filter and that of the circuit board on which the filter is surface-mounted after the shield is adhered to the dielectric block, a movable part 230 for allowing the adhered shield to be movable when frequency trimming to modify various characteristics of the filter after the shield and the dielectric block are adhered with each other, and an adhering surface 240 to be adhered to the dielectric block 100.

Figure 4:
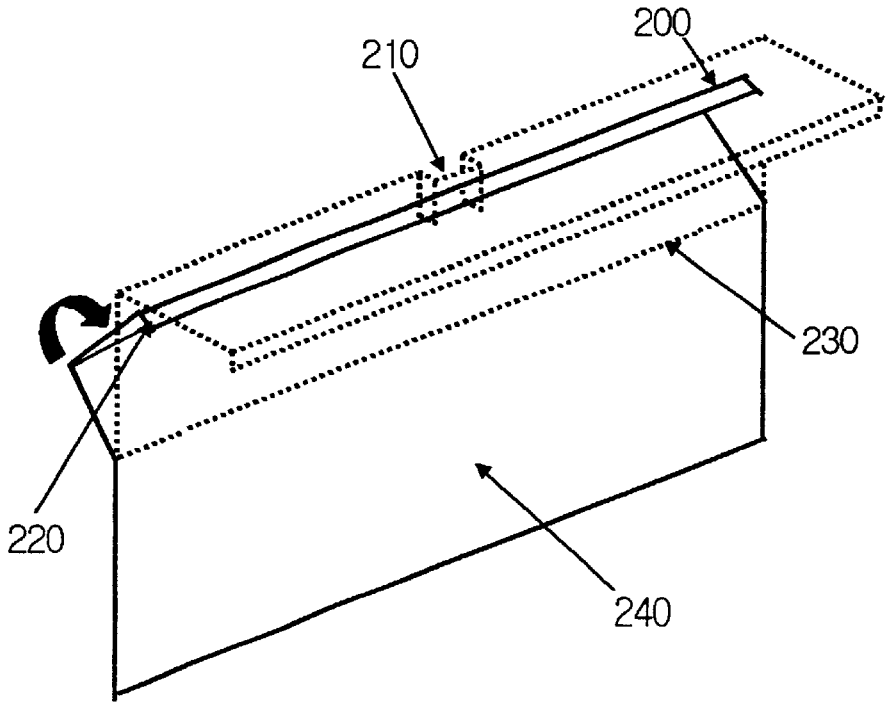
FIG. 4 is a perspective view showing the movable part of the shield shown in FIG. 3.

FIG. 4 schematically illustrates the appearance of the movable part of the shield while being operated, in which the upper part of the shield 200 is depicted in solid lines during the folding operation and the original appearance of the shield is depicted in dotted lines. Here, it is convenient to fold the upper part reward to an angle of 60° to 90° so as to perform frequency trimming for changing various characteristics of the filter.

Figure 5:
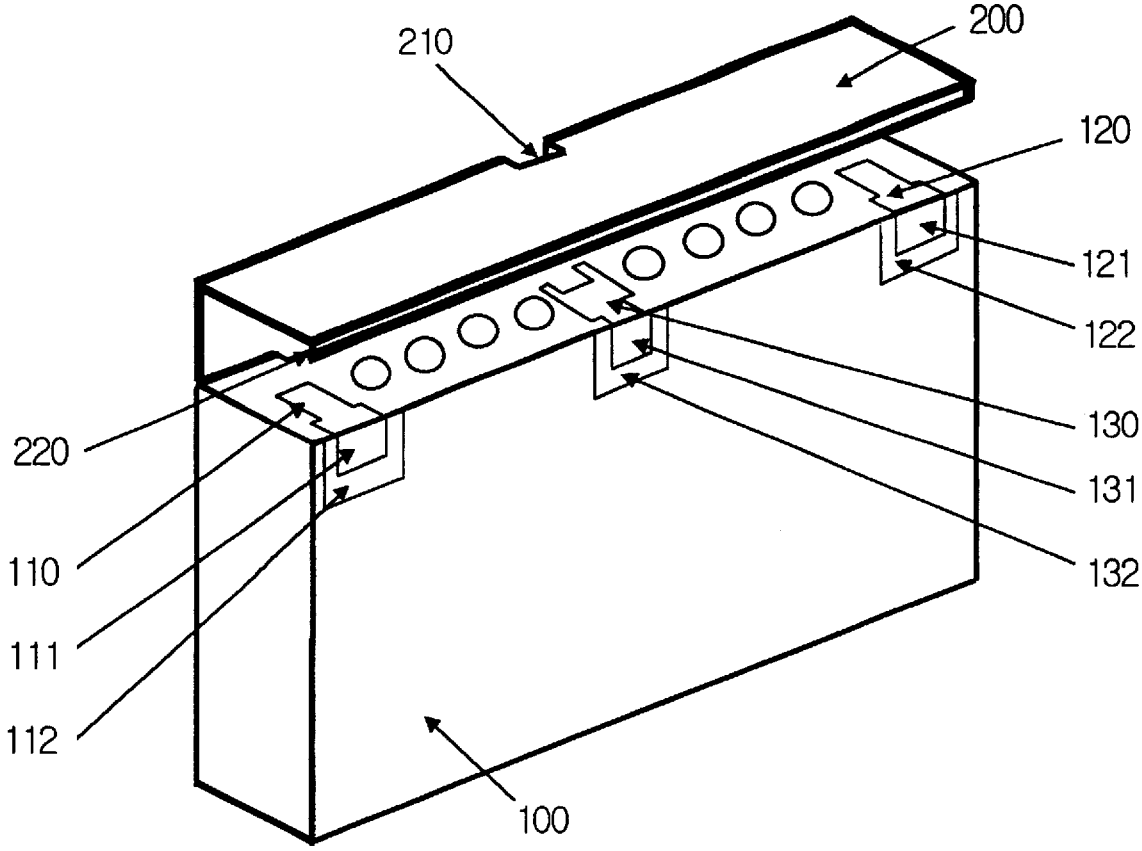
FIG. 5 is a perspective view of the microwave filter of FIG. 1 showing the rear side thereof.

FIG. 5 is a perspective view of the microwave filter of FIG. 1 showing the rear side thereof, reference numerals and functions of the constituents shown in this drawing are same with those indicated in and described with reference to FIG. 1.

As explained in the above, the present invention has advantageous effects in that a prescribed spacing between the dielectric block and the shield formed of an electromagnetic wave-absorptive material is easily obtained by using the window while the shield is being fixed, and in that the shortage of an electrical circuit provided in the opening of the filter caused by the leakage of the conductive adhesive coated on the internal surface can be effectively prohibited also by using the window.

Additionally, by providing the movable part in the shield, the frequency trimming can be readily performed as required, even after the shield is fixed on the dielectric block. Furthermore, the present invention is designed so that when the shield formed of an electromagnetic wave-absorptive material is fixed on the dielectric block and then practically surface-mounted on a printed circuit board, one end portion of the shield is folded in an L-shape to form a wide ground surface, thereby its ground characteristics can be improved.

Although representative embodiments of the present invention have been disclosed for illustrative purposes, those who are skilled in the art will appreciate that various modifications, additions and substitutions are possible without departing from the scope and spirit of the present invention as defined in the accompanying claims and the equivalents thereof.

What we claim:

1. A microwave filter for electromagnetic interference shielding, comprising: a block of dielectric material plated with a metal with the exception of one surface, a plurality of resonators contained within the dielectric block, and a shield fixed on the plated surface, the shield having at least an alignment window for securing the easy alignment of the dielectric block and the shield through a visual observation and a wide ground part formed by folding an end portion of the shield remote from the part fixed to the dielectric block, whereby the shield can be easily grounded to a ground surface of a printed circuit board.

2. The microwave filter according to claim 1, wherein the wide ground part is folded rearward at its distal end portion remote from the part fixed to the dielectric block.

3. The microwave filter according to claim 1, wherein the upper part of the shield is the movable part which can be folded rearward, whereby the frequency trimming can be easily performed even after the shield is fixed on the dielectric block.

4. The microwave filter according to claim 1, wherein the movable part is folded to an angle of 60° to 90°.

5. The microwave filter according to claim 1, wherein the shield is formed with an embossed part, by which projections are formed on the inside of the shield while grooves are formed on the outside of the shield, so that the easy alignment, through a visual observation, between the dielectric block and the shield can be secured and a required spacing between the dielectric block and the shield can be obtained.

6. A microwave filter for electromagnetic interference shielding, comprising: a block of dielectric material plated with a metal with the exception of one surface, a plurality of resonators contained within the dielectric block, and a shield fixed on the non-plated surface, wherein the shield has at least an alignment window for securing the easy alignment of the dielectric block and the shield through a visual observation, the shield comprising an upper part having a moveable part that can be folded rearward, whereby the frequency trimming can be easily performed even after the shield is fixed on the dielectric block.

7. A microwave filter for electromagnetic interference shielding, comprising: a block of dielectric material plated with a metal with the exception of one surface, a plurality of resonators contained within the dielectric block, and a shield fixed on the non-plated surface, wherein the shield has at least an alignment window for securing the easy alignment of the dielectric block and the shield through a visual observation, the shield comprising a moveable part that is folded rearward to an angle of 60° to 90°.

8. A microwave filter for electromagnetic interference shielding, comprising: a block of dielectric material plated with a metal with the exception of one surface, a plurality of resonators contained within the dielectric block, and a shield fixed on the non-plated surface, wherein the shield has at least an alignment window for securing the easy alignment of the dielectric block and the shield through a visual observation, the shield formed with an embossed part having projections formed on an inside of the shield and groves on an outside of the shield such that easy alignment through a visual observation between the dielectric block and the shield can be secured and a required spacing between the dielectric block and the shield can be obtained.

* * * * *